United States Patent [19]

Ito et al.

[11] Patent Number: 4,520,780

[45] Date of Patent: Jun. 4, 1985

[54] DIESEL FUEL INJECTION PUMP WITH FUEL INJECTION CUTOFF UPON DETECTION OF EXCESSIVE ACTUAL FUEL COMBUSTION TIME

[75] Inventors: Yoshiyasu Ito; Fumiaki Kobayashi; Hideo Miyagi, all of Toyota, Japan

[73] Assignee: Toyota Jidosha Kabushiki Kaisha, Toyota, Japan

[21] Appl. No.: 650,246

[22] Filed: Sep. 13, 1984

[30] Foreign Application Priority Data

Dec. 22, 1983 [JP] Japan ..... 58-242969
Jan. 23, 1984 [JP] Japan ..... 59-9755

[51] Int. Cl.[3] ..... F02D 31/00

[52] U.S. Cl. ..... 123/359; 123/198 DB; 123/458; 123/459

[58] Field of Search ..... 123/359, 357, 358, 198 DB, 123/479, 458, 459, 506, 449

[56] References Cited

U.S. PATENT DOCUMENTS

| | | | |
|---|---|---|---|
| 1,664,608 | 4/1928 | French | 123/458 |
| 3,693,603 | 9/1972 | Lemanczyk | 123/458 |
| 4,018,201 | 4/1977 | Williams et al. | 123/359 |
| 4,385,614 | 5/1983 | Eheim et al. | 123/506 |
| 4,395,987 | 8/1983 | Kobayashi et al. | 123/458 |
| 4,412,519 | 11/1983 | Hock et al. | 123/458 |
| 4,480,619 | 11/1984 | Igashira et al. | 123/459 |

FOREIGN PATENT DOCUMENTS

| | | | |
|---|---|---|---|
| 65858 | 4/1982 | Japan | 123/449 |
| 2105067 | 3/1983 | United Kingdom | 123/359 |

*Primary Examiner*—Magdalen Y. C. Moy
*Attorney, Agent, or Firm*—Kenyon & Kenyon

[57] ABSTRACT

A fuel injection pump for a diesel engine includes an input shaft rotated with the crankshaft, and a housing and a plunger which slides in a bore formed in the housing and is coaxial with the input shaft, with a high pressure chamber being defined at an end of the plunger between it and the bore. The plunger rotates with the input shaft and reciprocates so as to pump fuel at high pressure from the high pressure chamber to the engine cylinders, under the control of an electrically actuated electromagnetic valve, comprising a solenoid coil, which selectively vents the high pressure chamber according to the control of a control means, so as to provide fuel injection in appropriate amount to the diesel engine. There is provided a means for determining whether or not the voltage across the solenoid coil of the electromagnetic valve, when supply of power thereto changes from the ON to the OFF condition, rises higher than a certain value, or not. If a determining means detects that this voltage across the solenoid coil has not so risen, this lack of high transient voltage spike indicating that the solenoid coil may be discontinuous or functioning abnormally, then the engine is restrained. This restraint may consist of interrupting fuel flow to the engine to totally stop it, or of restricting air intake to the engine so as to put a ceiling on its rotational speed.

7 Claims, 12 Drawing Figures

FIG. 7
FIG. 7a
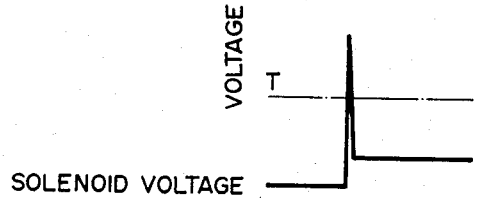
FIG. 7b
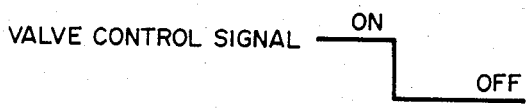
FIG. 10
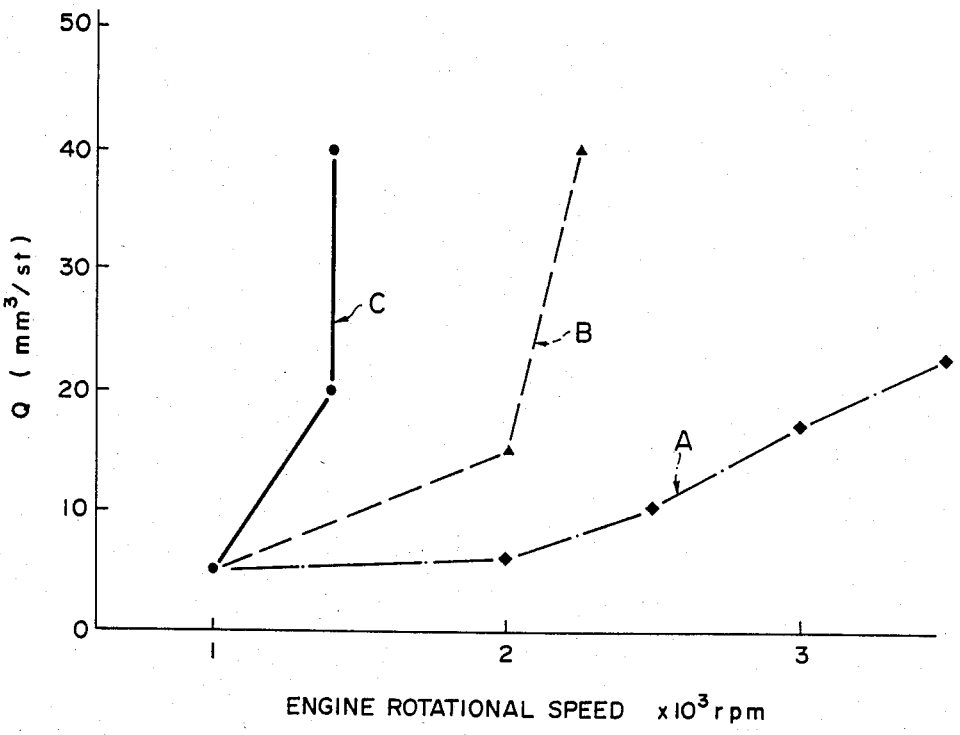

DIESEL FUEL INJECTION PUMP WITH FUEL INJECTION CUTOFF UPON DETECTION OF EXCESSIVE ACTUAL FUEL COMBUSTION TIME

BACKGROUND OF THE INVENTION

The present invention relates to a fuel injection pump for a diesel engine, and more particularly relates to a type of diesel fuel injection pump in which the injection of fuel can be cut off by a fail safe mechanism if discontinuity or abnormality in an electromagnetic valve for fuel injection amount control is detected.

In a diesel engine, the diesel fuel is injected at high pressure by a diesel fuel injection pump through fuel injectors into the cylinders of the engine in turn upon their compression strokes, and ignites due to the natural compression in the cylinders and is combusted therein without any special electrical or mechanical ignition means being required. Therefore in such a diesel engine there is a risk that if the fuel injection pump develops some abnormality the injection of fuel may be performed to too great an extent. For example, the injection of fuel may be performed in an amount corresponding to full engine load, even when the load on the engine is less than full load; or, worse, the injection of fuel may be continued to be performed, even when it is desired to completely terminate fuel injection and to stop the diesel engine running. In such a case, the danger arises of the diesel engine overrunning or overreving, and this type of malfunction can be very troublesome.

There is known a type of fuel injection pump for a diesel internal combustion engine which includes a plunger which reciprocates to and fro in a bore defined in a housing, a high pressure chamber being defined between one end of the plunger and the end of the bore. During the suction stroke of the plunger as this high pressure chamber expands in size, diesel fuel is sucked into this high pressure chamber from a quantity of diesel fuel contained in a relatively low pressure chamber through a fuel supply passage; and during the compression stroke of the plunger as the high pressure chamber subsequently contracts in size, this diesel fuel in the high pressure chamber is squeezed and is brought to a high pressure and is ejected through an injectionn passage therefor to a fuel injector of the diesel internal combustion engine. Sometimes, in the case that the diesel fuel injection pump is a so called distribution type pump, the plunger is rotated as it reciprocates by an input shaft which is rotationally coupled to it although not axially coupled to it, and by a per se well known construction the spurt of highly compressed diesel fuel is directed to the appropriate one of the plurality of cylinders of the internal combustion engine. Now, such a fuel injection pump injects an amount of diesel fuel in each pump stroke which is regulated by a fuel injection amount control means which selectively vents the high pressure chamber. This control means ceases to vent the high pressure chamber when it is appropriate to start the fuel injection spirt, during the compression stroke of the plunger, and at this instant the almost incompressible diesel fuel in the high pressure chamber starts to be squeezed and injected, as explained above. When it is appropriate to terminate the fuel injection spirt, then the control means starts again to vent the high pressure chamber, and at this instant the diesel fuel in the high pressure chamber ceases to be squeezed and therefore the injection is immediately stopped.

In the case of a mechanical diesel fuel injection pump, it has been conventional for this high pressure chamber selective venting means to be a spill ring, which is mechanically positioned according to the position of the accelerator pedal which is controlling the load on the engine, and whose position controls the timing instant of the end of the non-vented time period of the high pressure chamber. In such a mechanical type of fuel injection diesel pump, it is very rare for such a malfunction to develop as that the venting of the high pressure chamber should fail, because of the simple structure of the spill ring construction, and because of the fact that typically the accelerator pedal simply positions the spill ring through a simple linkage, and in such a construction there is no very important requirement for a system to prevent engine overrunning of the sort described above. However, in a more sophisticated mechanical type system of this sort, in which the linkage between the position of the accelerator pedal and the position of the spill ring is not a simple mechanical one but is, for example, performed electronically, it has been known to compare the required fuel injection amount with the actual position of the spill ring and to interrupt fuel injection if they do not agree, at least to within some prescribed margin of error.

However, nowadays electronically controlled fuel injection pumps are coming into use, in which the selective venting of the high pressure chamber is performed, not mechanically by the use of a spill ring, but electronically by an electromagnetic valve which is controlled by an electronic control system such as one incorporating a microcomputer. In such an electronic fuel injection pump, the electronic control system, for each spirt of fuel injection, calculates how much fuel is to be injected in this spirt, and then at an appropriate time point for the start of fuel injection closes said electromagnetic valve, so as to terminate fuel spilling from the high pressure chamber and so as thereby to start fuel injection. After the electronic control system has calculated that the proper amount of fuel has been injected by the movement of the plunger in the direction to reduce the size of the high pressure chamber, then said control system opens said electromagnetic valve for fuel spilling again, thus immediately terminating fuel injection. In such an electronic type of fuel injection pump, since there exists no spill ring, such a comparison of the required fuel injection amount with the actual position of the spill ring is of course impossible, and accordingly some other method is required for preventing engine overrunning. Also, because the control valve that regulates the amount of fuel spilled from the high pressure chamber and the timing of such spilling is an electromagnetic valve, there is a quite significant risk of malfunction of such a valve.

Specifically, it is often the case that the electromagnetic valve for fuel spilling is an electrically activated valve of the type that is open when supplied with electrical energy and is closed when not supplied with electrical energy, i.e. functions so as to vent the high pressure chamber when supplied with electrical energy and functions so as not to vent the high pressure chamber when not supplied with electrical energy. A typical type of malfunction of such an electromagnetic valve is for the solenoid coil thereof to become discontinuous, so that its electromagnetic function is impaired or completely destroyed. If this occurs, then no fuel spilling from the high pressure chamber will occur at all, since the electromagnetic valve for fuel spilling is always closed, and this will mean that diesel fuel will always be injected to the combustion chambers of the diesel engine to the maximum amount, causing definite running away of the engine. The risk of this overrevving and runaway operation of the engine makes the provision of a means for detecting such malfunction of the electromagnetic valve for fuel spilling very important, as well as making it important to provide a means for controlling the diesel engine in such an eventuality.

SUMMARY OF THE INVENTION

Accordingly, it is a primary object of the present invention to provide a diesel fuel injection pump, which has a reliable means for detecting disconnection or abnormality of the solenoid coil of an electromagnetic valve for fuel spilling of the type described above.

It is a further object of the present invention to provide such a diesel fuel injection pump, which can detect when disconnection or abnormality of the solenoid coil of an electromagnetic valve for fuel spilling have occurred, and which interrupts fuel injection in such a case.

It is a further object of the present invention to provide such a diesel fuel injection pump, which can detect disconnection or abnormality of the solenoid coil of an electromagnetic valve for fuel spilling, and which completely and definitely stops operation of the diesel engine in such a case.

It is a further object of the present invention to provide such a diesel fuel injection pump, which can detect disconnection or abnormality of the solenoid coil of an electromagnetic valve for fuel spilling, and which curbs the operation of the diesel engine in such a case.

It is a further object of the present invention to provide such a diesel fuel injection pump, which can detect disconnection or abnormality of the solenoid coil of an electromagnetic valve for fuel spilling, and which puts a maximum on the revolution speed of the diesel engine in such a case.

It is a further object of the present invention to provide such a diesel fuel injection pump, which can detect disconnection or abnormality of the solenoid coil of an electromagnetic valve for fuel spilling, and which in such a case still allows of emergency running of the diesel engine while preventing any catastrophic running away thereof.

It is a further object of the present invention to provide such a diesel fuel injection pump, which reliably prevents engine overrunning and overrevving.

It is a further object of the present invention to provide such a diesel fuel injection pump, which is fail safe.

According to the most general aspect of the present invention, these and other objects are accomplished by, for a diesel engine comprising cylinders and a crankshaft: a fuel injection pump, comprising: (a) an input shaft which is rotated in a predetermined phase relationship with said crankshaft; (b) a housing and a plunger which slides in a bore formed in said housing and is coaxial with said input shaft, a high pressure chamber being defined at an end of said plunger between it and said bore, and another end of said plunger being rotationally engaged with said input shaft but being free to move axially with respect thereto; (c) a means for communicating said high pressure chamber to inject fuel into one or another cylinder of said diesel engine, according to the rotational position of said plunger, substantially only when said plunger is axially moving so as to reduce the size of said high pressure chamber; (d) an electrically actuated electromagnetic valve, comprising a solenoid coil, which selectively vents said high pressure chamber; (e) a means for selectively actuating and deactuating said electromagnetic valve, so as to provide fuel injection in appropriate amount to said diesel engine; (f) a means for determining whether or not the voltage across said solenoid coil of said electromagnetic valve, when said means for selectively actuating and deactuating said electromagnetic valve deactuates said electromagnetic valve from its actuated condition, rises higher than a certain value, or not; (g) a means for restraining said diesel engine; and (h) a means for actuating said means for restraining said diesel engine if said determining means detects that said voltage across said solenoid coil of said electromagnetic valve when it is deenergized from the energized condition has not risen to higher than said certain value.

According to such a structure, the diesel engine is restrained, when the means for doing so determines that the voltage across the solenoid coil has not risen to greater than said certain value, when said solenoid coil is deenergized. Such a lack of voltage rise, in other words an absence of high voltage transient spike caused by self inductance of the solenoid coil, is taken as indicating that the solenoid coil has failed by becoming discontinuous, or in some other way has started to function abnormally, and according to this the operation performed by the present invention as outlined above of restraining the diesel engine means that the dangers of overrunning or overrevving of said diesel engine in such a failure condition are positively avoided. Thus, the diesel fuel injection pump is made to be fail safe.

Further, according to a more particular aspect of the present invention, these and other objects are more particularly and concretely accomplished by such a diesel fuel injection pump as described above, wherein said means for restraining said diesel engine completely cuts off operation of said diesel engine when actuated; and this may be done by providing a valve for cutting off supply of fuel to said high pressure chamber in such an event.

According to such a structure, the diesel engine cannot be operated at all, when failure or abnormality of the solenoid coil are detected; and thus the fail safe operation of this specialization of the present invention is absolutely assured.

Further, according to a more particular aspect of the present invention, these and other objects are more particularly and concretely accomplished by such a diesel fuel injection pump as described above, wherein said means for restraining said diesel engine restricts the rotational speed of said diesel engine to less than a certain ceiling value, when actuated; and this may be done, said diesel engine further comprising an intake system, by providing a means for restricting the flow of intake air through said intake system, when actuated.

According to such a structure, the diesel engine can still be operated at low rotational speed, in other words in a limping emergency mode, when failure or abnormality of the solenoid coil are detected; and thus it becomes possible for the operator of a vehicle incorporating the engine to slowly bring the vehicle to a service facility, for example.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

FIG. 7 is a timing chart, showing in its FIG. 7*a* a spike of induced voltage across the solenoid coil of an electromagnetic solenoid valve for fuel spilling, and in its FIG. 7*b* the changing of a control signal for said solenoid valve from ON to OFF which caused said voltage spike;

FIG. 10 is a graph, showing engine revolution speed along the horizontal axis and fuel injection amount per unit injection stroke of the fuel injection pump along the vertical axis, in three different throttling conditions of the intake system of the engine.

DESCRIPTION OF THE PREFERRED EMBODIMENTS

Figure 1:
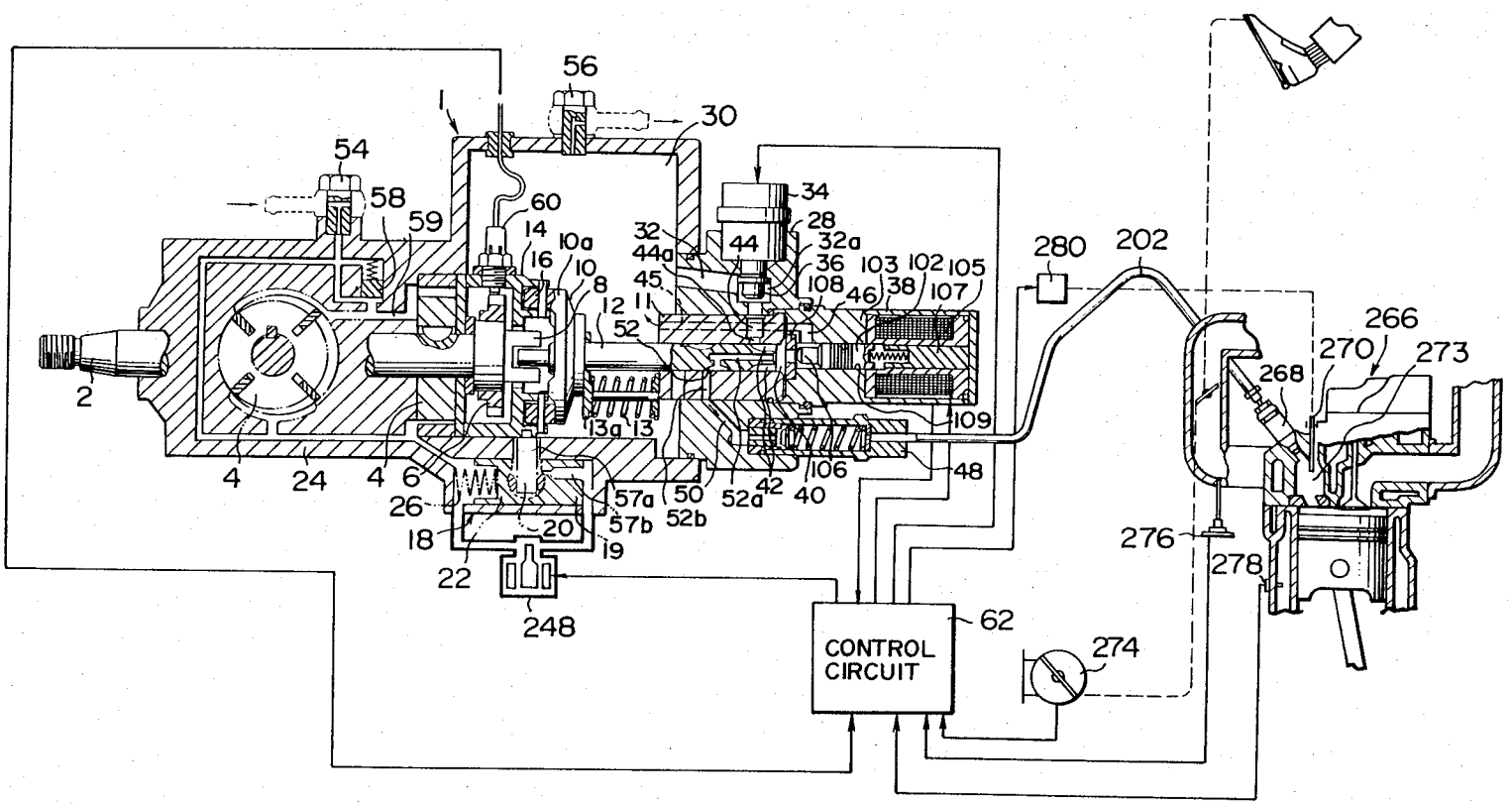
FIG. 1 is a sectional longitudinal view, in part 90° expansion, of the first preferred embodiment of the diesel fuel injection pump of the present invention, also showing a section of the diesel engine to which it is fitted, and an accelerator pedal and a driver's foot therefor.

The present invention will now be described with reference to the preferred embodiments thereof, and with reference to the appended drawings. Referring to FIG. 1, which shows the first preferred embodiment, this diesel fuel injection pump 1 is an electromagnetic spilling type distribution type fuel injection pump, and comprises a drive shaft 2 adapted to be driven by a crankshaft, not particularly shown, of a diesel engine, which is partially shown in sectional view in the figure, in a predetermined phase relationship thereto. The diesel engine to which the exemplary first preferred embodiment is to be fitted is in fact a four cylinder four stroke diesel engine. The drive shaft 2 drives a vane type feed pump 4 (shown in a plane section in FIG. 1 which is at 90° to the general plane of the figure), which feeds diesel fuel supplied via a fuel supply connection 54 and, by the control of a venting pressure control valve 58, under a moderate pressure (which is representative of the rotational speed of said vane pump 4 and thus of the rotational speed of the drive shaft 2 and of the diesel engine) through a passage 59 to a large fuel chamber 30 defined within the housing 24 of the fuel injection pump 1, fuel in said large fuel chamber 30 being vented, when appropriate, via a fuel return connection 56 incorporating a proper orifice passage. The drive shaft 2 has mounted at an intermediate position on it a signal rotor 6, having a plurality of teeth formed thereon, and is at its right end in the figure formed with a coupling shape 8. An electromagnetic pickup 60 is mounted to a roller ring 14 described later in the housing 24 opposing the teeth of the signal rotor 6 for producing electrical signals regarding the angular position of the drive shaft 2 when the teeth of said rotor 6 pass it. A generally cylindrical plunger 12 is mounted with its central axial line coincident with the central axis of the drive shaft 2, and its left end in the figure is formed in a coupling shape which fits together with the coupling shape 8 of the drive shaft 2 so that the plunger 12 is rotationally coupled to the drive shaft 2 while being free to move axially with respect thereto. The cylindrical right end in the figure of the plunger 12 is closely and cooperatingly fitted into a cylindrical bore formed in a boss portion 11 fitted in the pump housing 24 and can slide and rotate freely in said bore; and the plunger 12 is biased to the left in the figure by a compression coil spring 13 and a collar 13*a* fitted on a lange shaped portion 12*a* of the drive shaft 2 and associated spring receiving elements, etc.

A cam plate 10 is fixedly secured around the left hand end in the figure of the plunger 12 and rotates integrally therewith, and the left hand side of this cam plate 10 is formed in an axial circular cam shape bearing a plurality of convex and concave cam portions, the convex ones being designated in the figure by the symbol 10*a*. The roller ring 14, which as mentioned above supports the electromagnetic pickup 60, is rotatably mounted to the housing 24 of the fuel injection pump, around the coupling shape 8 and mutually concentric therewith, and is provided with a plurality of cam rollers 16 rotatably mounted along the outer circumferential part of its right hand side in the figure, bearing against the cam plate 10, with the central rotational axis of each of said cam rollers 16 extending radially perpendicular to the central axis of the drive shaft 2. The number of the cam rollers 16 and the number of the convex cam portions 10*a* are such that, as the plunger 12 and the cam plate 10 rotate through one full revolution with respect to the roller ring 14, the cam action of the cam portions 10*a* on the rollers 16 causes the plunger 16 to be reciprocated axially to and fro by the same number of times as the number of cylinders of the diesel engine. Thus, in the shown exemplary first preferred embodiment which is a fuel injection pump for a four cylinder diesel engine, there are provided four equally spaced cam rollers 16 and four equally spaced convex cam portions 10*a* (although some of both of these are not visible in the figure). The roller ring 14 is rotatably mounted to the pump housing 24, and its angular position is variably controlled with respect thereto by a timer 18, schematically shown in a plane section at 90° to the general plane of the figure, and this timer 18 comprises a timer piston 22 slidably mounted in a bore formed in the pump housing 24 and a pin 20 radially mounted to the roller ring 14 and engaged at its free end portion with the timer piston 22 so as to be rotationally turned and to rotationally position said roller ring 14. The timer piston 22 is biased in its rightwards axial direction in the figure as viewed in said 90° turned plane section by a compression coil spring 26 mounted between its left hand end in the figure and the corresponding end of its bore, and is biased in the leftwards axial direction by the output pressure of the vane pump 4, which is supplied via passages 57*a* and 57*b* to chamber 19 defined at the right hand end in the figure of said bore, in such a manner that the axial movement of the timer piston 22 leftward in the figure is representative of the rotational speed of the crankshaft of the engine, and drives the roller ring 14 to rotate it in the direction opposite to the rotational direction of the drive shaft 2 so as to advance the fuel injection timing by an amount determined by the output pressure of the vane pump 4, i.e. determined by the revolution speed of the crankshaft of the diesel engine. However, this basic fuel injection advancing is modified by the provision of an electromagnetic valve 248, which is connected so as selectively to release a certain amount of fuel from the chamber 19, according to selective control by a control system 62 which will be described later; this arrangement enables the control system 62 to alter the actual ignition timing to agree with a desired reference ignition timing.

On the right hand side in FIG. 1 of the fuel injection pump 1 there is mounted in the housing 24 a block 28, in which the aforementioned boss 11 is fitted. A fuel passage 32 leads from the large fuel chamber 30 to an intermediate fuel chamber 32*a* defined within the block 28, and a passage 44 leads from said intermediate fuel chamber 32*a* to a fuel supply port 44*a* which opens in the side surface of the cylindrical bore in the boss 11 in which the plunger 12 reciprocates. An electromagnetic valve 34 for fuel shutting off is provided, and a valve element 36 of this valve 34 is so constructed and arranged that: when the solenoid coil (not particularly shown) of the electromagnetic valve 34 is supplied with actuating electrical energy, its valve element 36 is moved upwards in the figures away from the upper end 36*a* of the passage 44, thus opening said upper end 36*a* and allowing communication between the passage 32 and the passage 44; but, on the other hand, when said solenoid coil of this electromagnetic valve 34 for fuel shutting off is not supplied with actuatig electrical energy, its valve element 36 is moved downwards by the action of a spring (likewise not particularly shown) towards said upper end 36*a* of the passage 44 and blocks it, thus interrupting communication between the passage 32 and the passage 44.

The outer cylindrical surface of the right hand end of the plunger 12 is formed with a plurality of axially extending grooves 42, which are equally spaced around said plunger 12 and reach its end and whose number is the same as the number of cylinders of the diesel engine and which are arranged sometimes one or other to coincide with the fuel supply port 44*a*, according to rotation and reciprocation of the plunger 12; and a central axial hole 52*a* is formed along the axis of said plunger 12, one end of said hole 52*a* opening to the right hand end surface of the plunger 12 and the other end of said hole 52*a* opening to a side notch port 52 provided on the outer cylindrical surface of an intermediate portion of the plunger 12. A plurality of delivery valves 48 in number the same as the number of cylinders of the diesel engine are mounted in the block 28 (only one of the valves 48 with its associated arrangements is shown in FIG. 1 for the purposes of simplicity), and the inlet of each of these delivery valves 48 is selectively supplied with diesel fuel via a passage 50 which leads to a fuel receiving port 52*b* which opens in the side surface of the cylindrical bore in the boss 11 in which the plunger 12 reciprocates; the ports 52*b* are equally spaced around the plunger 12 and also are in number the same as the number of cylinders of the diesel engine, i.e. are four in number in this shown first preferred embodiment. Each of the delivery valves 48 is connected via a high pressure fuel pipe to a fuel injector fitted in a corresponding one of the cylinders of the diesel engine, for supplying diesel fuel under high pressure thereto at an appropriate amount and timing. The side notch port 52 is arranged to sometimes coincide with one or other of the fuel receiving ports 52*b*, also according to rotation and reciprocation of the plunger 12.

A high pressure chamber 40 is defined between the right hand end of the plunger 12 and an electromagnetic valve for fuel spilling 38 fitted to the block 28 and closing the end of the cylindrical bore in the boss 11 in which said plunger 12 reciprocates, in cooperation with the cylindrical side surface of said bore, with the ends of the notches 42 and the end of the central hole 52*a* in the plunger 12 communicating to this high pressure chamber 40; and this electromagnetic valve for fuel spilling 38 regulates escape of fluid from the high pressure chamber 40. The fuel vent passage 46 of this electromagnetic valve for fuel spilling 38 is communicated, via an intermediate passage 45 formed in the boss 11, to the large fuel chamber 30.

The electromagnetic valve for fuel spilling 38 comprises a housing 103 in which the return passage 46 mentioned above is formed, and an iron core 107 is fitted in this housing 103 and has an electromagnetic coil 105 wound around it. A cylindrical bore 109 of relatively large diameter formed in the valve housing 103 has a cylindrical valve element 102 fitted therein so as to be reciprocable along the axis thereof. The valve element 102 has a relatively thin left hand end tip 106, which cooperates with a hole formed in a valve seat member 108 so as selectively to close or to open said hole, according as said valve element 102 is pushed thereagainst, or not, respectively. A compression coil spring 104 is fitted between the iron core 107 and the right hand end of the valve element 102, so as to bias the value element 102 leftwards as seen in the figure, against said hole in said valve seat member 108. The space to the right of the valve seat member 108 is communicated to the upstream end of the return passage 46, and the left side in the figure of the valve seat member 108 defines the right side of the high pressure chamber 40.

Thus, when no electrical energy is supplied to the coil 105, then the iron core 107 is not magnetized, and thus the compression coil spring 104 biases the valve element 102 leftwards in the figure, so that the end 106 thereof closes the hole in the valve seat member 108, and this seals off the high pressure chamber 40 from the return passage 46. On the other hand, when actuating electrical energy is supplied to the coil 105, then the iron core 107 is magnetized, and then against the biasing action of the compression coil spring 104 which is overcome the valve element 102 is pulled thereby rightwards in the figure, so that its end opens the hole in the valve seat member 108, and this opens a passage from the high pressure chamber 40 to the return passage 46, allowing a flow of fluid out from the pressure chamber 40 and depressurizing said pressure chamber 40.

The delivery valve 48 is connected, via a conduit 202, to a fuel injection valve 268 which is fitted to one of the cylinders of the diesel engine. In fact, in this exemplary construction, the fuel injection valve is fitted to a secondary combustion chamber 273 for this cylinder. Also to this secondary combustion chamber 273 is fitted a glow plug 270, projecting into said secondary combustion chamber 273.

Further, an accelerator pedal depression amount sensor 274 provides an electrical output signal representative of accelerator pedal depression amount, i.e. of engine load; an intake manifold pressure sensor 276 provides an electrical output signal representative of the pressure in the intake manifold of the diesel engine; a water temperature sensor 278 provides an electricasl output signal representative of the temperature of the cooling water of the diesel engine; and a glow relay 280 controls supply of electrical energy to the glow plug 270. The electrical output signals of the sensor 62 of the fuel injection pump 1, of the accelerator pedal depression amount sensor 274, of the intake manifold pressure sensor 276, and of the water temperature sensor 278, are fed into a microcomputer incorporated in a control circuit 62 for the fuel injection pump 1; and the glow relay 280 and the solenoids of the electromagnetic valve for fuel spilling 38, of the electromagnetic valve 248 for timing control, and of the electromagnetic valve 34 for fuel shutting off are fed from an output port construction of said microcomputer.

Figure 2:
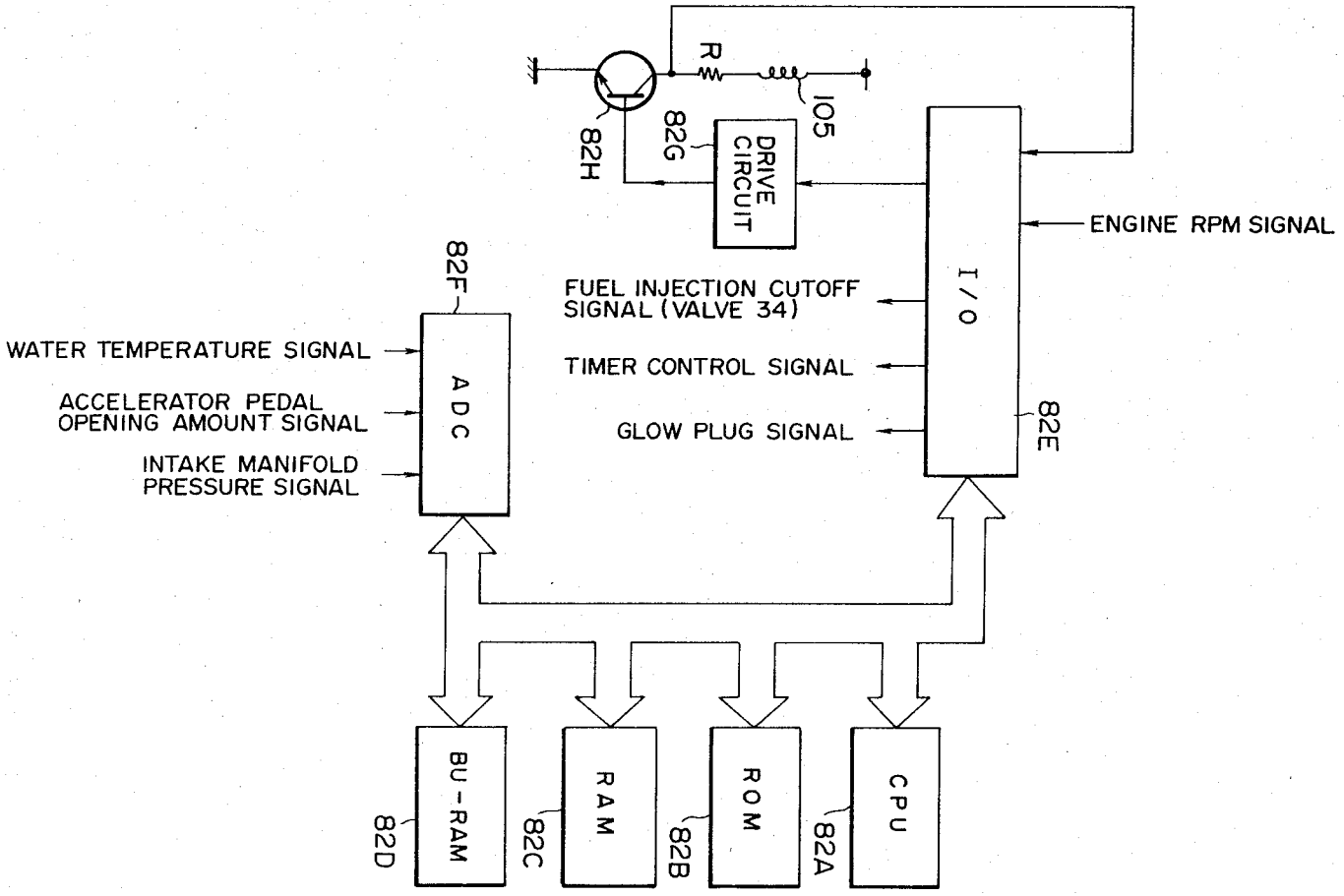
FIG. 2 is a diagrammatical view of a microcomputer and of associated electrical circuitry, incorporated in the control system of this first preferred embodiment.

The internal construction of this microcomputer is schematically shown in FIG. 2. This microcomputer has a central processing unit (CPU) 82A, a read only memory (ROM) 82B, a random access memory (RAM) 82C, a back up random access memory (BU-RAM) 82D, and I/O port 82E, an analog/digital converter (ADC) 82F, and a bus which interconnects these elements, and so on; and the control circuit 62 also includes a drive circuit 82G and transistor 82H. The analog/digital converter 82F converts the analog output signals from the accelerator pedal depression amount sensor 274, the intake manifold pressure sensor 276, and the water temperature sensor 278 into digital signals under the control of the CPU. The read only memory (ROM) has permanently stored in it a control program concerning fuel injection amount and so on, which includes several subroutines which will be described later, as well as various constants and other data, including a table of fuel injection timing (or spill angle) as determined from fuel injection amount and engine rotational speed, as will be explained in more detail shortly. The control circuit 62, as a whole, performs control of fuel injection amount and other matters according to these signals as will be described hereinafter, by supplying control electrical signals to the electromagnetic valves 34, 248, and 38, as well as to the glow plug relay 280 for controlling the glow plug 270. The output signal from the sensor 60, which already is of a digital nature, is fed directly to the I/O port 82E. This I/O port 82E outputs control signals to the electromagnetic valves 34 and 248, and to the relay 280, and also supplies an ON/OFF signal for controlling the electromagnetic valve 38 for fuel spilling, i.e. a fuel injection amount control signal, to the input of a drive circuit 82G, the output of which is fed to the base of the transistor 82H. The emitter of the transistor 82H is connected to ground, and the collector of this transistor 82H is connected to the solenoid coil 105 of the valve 38 via a resistor R. A voltage signal is fed back from the collector of the transistor 82H to the I/O port 82E, in order for the microcomputer to have information of the actual voltage being applied across the coil 105 of the valve 38 for fuel spilling; the use of this will become apparent later.

Now, the action of this fuel injection pump 1 during operation of the diesel engine will be described. When the engine is running and the crankshaft (not shown) of said engine is rotating, the drive shaft 2 is rotated in synchrony therewith and at a predetermined phase in relation thereto (actually at half crankshaft speed, because this is exemplarily a pump for a four stroke diesel engine), and drives the vane pump 4, and fuel pressurized to the output pressure of said vane pump 4, which is representative of the rotational speed of said drive shaft 2 and of said crankshaft of the engine, is fed into the chamber 30 and into the fuel passages 32 and 44 and also into the actuating chamber 19 of the timer assembly 18, so as to cause the timer piston 22 to be driven leftwards in the figure (90° plane section) by an amount corresponding to said rotational speed of said engine, thus rotating the roller ring 14 and the rollers 16 mounted thereon by a similarly corresponding amount from their starting rotational positions relative to the housing 24 in the direction opposite to the rotational direction of the drive shaft 2. Meanwhile, as the drive shaft 2 and the plunger 12 rotate in synchronism with one another, and as the cam plate 10 is also rotated, the cam projections **10*a* are caused to ride up and down the rollers 16, so as to reciprocatingly drive the plunger 12 against the biasing force of the compression coil spring 13 leftwards and rightwards in the figure at appropriate timing governed by the aforesaid rotational position of the roller ring 14, as said plunger 12 also rotates, i.e. according to the rotational speed of the diesel engine, with the plunger 12 making one complete rotation for every two rotations of the crankshaft of the diesel engine, in this exemplary case of a four stroke type diesel engine. While the master running or ignition switch of the vehicle is turned on while the diesel engine is running normally, actuating electrical energy is being supplied to the electromagnetic valve 34 for fuel shutting off, and so its valve element 36 is displaced from the valve seat 36*a* and the fuel passage 32 is in communication with the fuel passage 44. Therefore, on each of the suction or leftward strokes of the plunger 12 when one of the notches 42 is corresponding to the fuel supply port 44*a* which opens in the side surface of the cylindrical bore in the boss 11, diesel fuel at relatively low pressure is sucked into the high pressure chamber 40 from the chamber 30 through said fuel passages 32 and 44**.

When thereafter the plunger 12 moves rightwards during its subsequent compression stroke, by the rotation of said plunger 12 said one of the notches 42 is no longer corresponding to the fuel supply port **44*a*, and accordingly back flow of diesel fuel to the passage 44 is prevented; and also the side notch port 52 is now coinciding with an appropriate of the fuel receiving ports 52*b*, also according to rotation of the plunger 12, so as to direct diesel fuel which is now being compresed in the high pressure chamber 40 by the rightward movement of the plunger to the appropriate one of the fuel delivery valves 48, via the hole 52***a* and said side notch port 52, so as to be injected into the appropriate cylinder of the engine via the relevant fuel injection valve 48, according to the per se well known distribution function of this fuel injection pump. However, this compression process of the diesel fuel within the high pressure chamber 40, and the injection thereof through the fuel delivery valve 48, only will take place if the coil 105 of the electromagnetic valve for fuel spilling 38 is not being provided with actuating electrical energy and thus said valve 38 is closed and is preventing communication between the high pressure chamber 40 and the vent passage 46. On the other hand, when actuating electrical energy is provided to said coil 105 of the valve 38, then the tip of the valve element 102 thereof is displaced from the hole in the valve seat member 108 as explained above, thus opening said hole, and thereby the high pressure chamber 40 is communicated with the vent passage 46, thus venting the compressed diesel fuel in the chamber 40 back to the large fuel chamber 30 to which said vent passage 46 communicates, and thereby cutting off fuel injection. During normal running of the diesel engine, the control circuit 62 supplies actuating electrical energy to the electromagnetic valve for fuel spilling 38 at an appropriate timing point during each fuel injection stroke of the plunger 12, so as to open said valve 38 and to cut off further fuel injection during this plunger stroke, according to the various signals regarding engine operational parameters which said control circuit 62 receives from its various sensors described above, as will shortly be described: this is how the amount of fuel injectingly supplied to the diesel engine, and thereby the load on said diesel engine, is controlled. This action of the control circuit 62 in venting the high pressure chamber 40 at an appropriate timing point is analogous to the operation of a spill ring in a conventional type of diesel fuel injection pump. When the diesel engine is running and it is desired to stop it from running, the master running switch of the vehicle is turned off by the operator, and this immediately causes stopping of supply of electrical energy to the electromagnetic valve 34 for fuel shutting off, so that its valve element 36 is moved against the valve seat 36*a* by the force of its biasing spring (not particularly shown) and communication between the fuel passage 32 and the fuel passage 44 is interrupted. Therefore, supply of new fuel to the diesel engine is terminated, and accordingly quickly the diesel engine comes to a halt.

Now, how the microcomputer incorporated in the control circuit 62 determines the amount of fuel to be injected in each injection spirt to each cylinder of the engine, in other words how said microcomputer determines the time for energizing the electromagnetic valve 38 for fuel spilling so as to terminate each spirt of fuel injection, and also how this microcomputer controls the electromagnetic valve 34 for fuel cutoff in order to provide a fail safe function for the diesel engine in the case of malfunctioning of the fuel injection pump occasioned by discontinuity of the electromagentic coil 105 of the electromagnetic valve 34 for fuel shutting off, will be particularly described, with reference to the flow charts of FIGS. 3, 4, 5, and 6.

Figure 3:
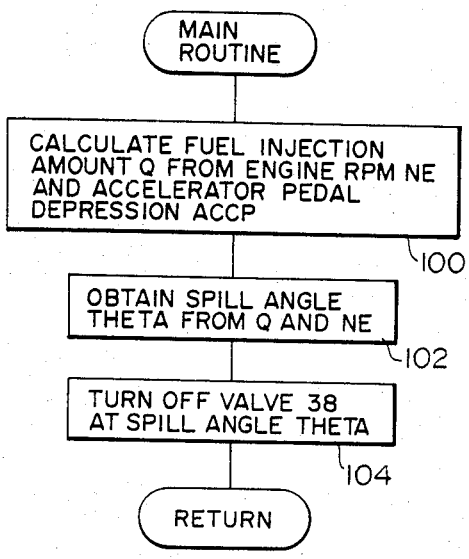
FIG. 3 is a flow chart showing a main fuel injection control routine stored in said microcomputer.

FIG. 3 shows the flow chart of the main fuel injection control program of this microcomputer. In the step 100 of this program, from the engine rotational speed NE as calculated from the output signal of the sensor 62 and from the accelerator pedal opening amount ACCP as detected by the accelerator pedal opening amount sensor 274 the basic fuel injection amount Q is calculated in the following way. In idling range, the fuel injection amount $QIDLE=KI-NE/KIC$, where $KI=1.75\times ACCP+79.0$, and $KIC=10$. And in partial and total load ranges, the fuel injection amount $QPART=KPA-NE/KPB$, where, if ACCP is between 0% and 20%, $KPA=1.56\times ACCP+20$ and $KPB=1.94\times ACCP+50$, while, if ACCP is between 20%, and 100%, $KPA=1.314\times ACCP+45$ and $KPB=2.18\times ACCP+45.2$. Thus, this program step 100 serves as a fuel amount computing means.

Then, in the step 102 of the program, corresponding to the current engine rotational speed NE and the desired fuel injection amount Q, a spill angle THETA is calculated, by interpolation from a table of THETA against engine rotational speed NE and desired fuel injection amount Q stored in the ROM of the microcomputer. Although the instant for spilling of the fuel from the high pressure chamber 40, i.e. the fuel injection end time, is herein spoken of and calculated in terms of a so called spill angle THETA, as in the case of a conventional fuel injection pump including a spill ring, this spilling is as explained here performed electronically. Next, in the step 104, when the crank angle becomes equal to this spill angle THETA, the electromagnetic valve 38 for fuel spilling is turned on, i.e. the injection of diesel fuel to the combustion chamber is by the spilling of the fuel in the high pressure chamber 40 which was being compressed. Then the main fuel injection amount calculation program returns.

Figure 4:
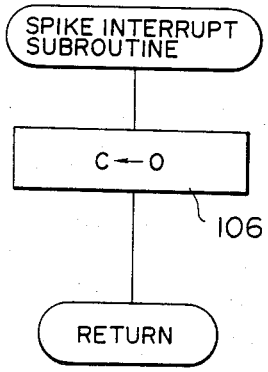
FIG. 4 is a flow chart showing a spike interrupt subroutine stored in said microcomputer.

In FIG. 4, there is shown the flow chart of an spike interrupt subroutine for the microcomputer incorporated in the control circuit 62, which is performed every time an interrupt occurs on the occasion of the output signal of the transistor 82H at its collector, which is as mentioned before fed back to the I/O port 82E, becoming higher than a certain fixed threshold value. In this spike interrupt subroutine, simply, in the step 106, the value of a count C is set to zero; and then the subroutine returns. The meaning of this is as follows, with reference to FIG. 7. When the electrical signal being supplied from the I/O port 82E to the solenoid coil 105 of the electromagnetic valve 38 for fuel spilling changes from an ON signal to an OFF signal as shown in FIG. 7*b*, then, due to the inductance of the solenoid coil 105, etc., a transient voltage spike is generated in the voltage thereacross, as shown in FIG. 7*a*, and the fixed threshold value T which this voltage across the solenoid coil 105 must exceed before an interrupt is caused is set to be so appropriately high that only when the solenoid coil 105 is in its proper continuous state and is functioning correctly as a solenoid coil can the transient voltage thus induced thereacross ever exceed the threshold value T. In other words, the rising of the voltage across the solenfoid coil 105 for a brief period to higher than the threshold value T can be taken as an assurance of the integrity and proper functioning of the solenoid coil 105; and when this voltage spike occurs, as described above, an interrupt occurs and the routine of FIG. 4 is performed, setting the value of the count C to zero.

Figure 5:
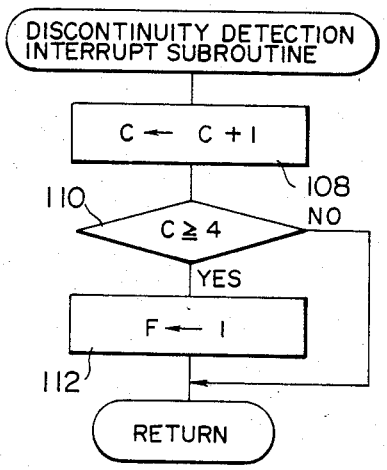
FIG. 5 is a flow chart showing a discontinuity detection interrupt subroutine stored in said microcomputer.

In FIG. 5, there is shown the flow chart of a discontinuity detection interrupt subroutine for the microcomputer incorporated in the control circuit 62, which is performed every time an interrupt occurs on the occasion of the fuel injection signal being given. In this discontinuity detection interrupt subroutine, first, in the step 108, the value of the count C is incremented by one. And next, in the step 110, a decision is made as to whether the value of the count variable C is greater than or equal to, exemplarily, four, or not; if it is not, which indicates that abnormal operation of the solenoid 105 of the electromagnetic valve 38 for fuel spilling has not yet been decided upon, then the flow of control passes to return directly; but if it is, which indicates that definitely abnormal operation of the solenoid 105 of the electromagnetic valve 38 for fuel spilling is now taking place, because four fuel injection episodes have now occurred since last a voltage spike was detected in the voltage across the solenoid coil 105 of said electromagnetic valve 38 for fuel spilling (vide the resetting to zero of the variable C in the subroutine of FIG. 4), then a flag F is set to 1, so as to indicate that proper action should be taken by the interrupt subroutine of FIG. 6; and then this discontinuity detection interrupt subroutine returns.

Figure 6:
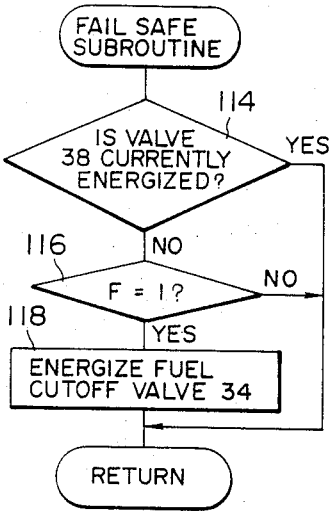
FIG. 6 is a flow chart showing a fail safe subroutine stored in said microcomputer.

In FIG. 6, there is shown the flow chart of a fail safe subroutine for the microcomputer incorporated in the control circuit 62. In this fail safe subroutine, first in the step 114 a decision is made as to whether an ON signal is being currently outputted to the electromagnetic valve 38 for fuel spilling, i.e. whether or not the solenoid coil 105 of said valve 38 is currently being energized; if said solenoid coil 105 is currently energized, then the fail safe routine directly returns. If, on the other hand, it is not, then in the step 116 a decision is made as to whether the value of the flag F is currently 1 or not; if the value of this flag F is not currently 1, indicating that the interrupt routine of FIG. 5 has not set this flag F and that currently the integrity of the solenoid coil 105 of the valve 38 is not in question, then the fail safe routine returns without doing anything. combustion was not taking place up to this present interrupt time and that On the other hand, if the flag F has become set to 1, then the flow of control is passed to the step 118, in which an OFF signal is transmitted to the solenoid of the electromagnetic valve 34 for fuel shutting off, and thereby the diesel engine is definitely and effectively stopped from operating; and the fail safe subroutine returns.

Thus if for four combustion episodes in a row, in this first preferred embodiment, the interrupt routine of FIG. 4 is not obeyed, i.e. no spike of voltage appears across the solenoid coil 105 of the electromagnetic valve 38 for fuel spilling, then the value of the count C will reach four, and then in the step 116 of the fail safe subroutine, a described above, the flow of control will be switched to the step 118 and the electromagnetic valve 34 for fuel shutting off will be actuated to definitely cut off the flow of fuel to the diesel engine and thereby definitely stop said engine. Thus, this action of this fail safe subroutine serves to definitely prevent the diesel engine from continuing to be operated in conditions of doubtful integrity of the solenoid coil 105.

According to the structure described above, it is seen that the fuel injection to the engine is completely and definitely terminated, when it is determined that the electrical characteristics of the solenoid coil 105 of the electromagnetic valve 38 for fuel spilling are abnormal, which may indicate faulty connectivity of said solenoid coil, i.e. may indicate that the valve 38 is always in the closed state and that thus a maximum amount of diesel fuel is being injected to the diesel engine irrespective of the setting of the accelerator pedal thereof. Thus, the danger of too much fuel being injected into the diesel engine, and of consequent overrunning or overrevving thereof, are positively avoided. Thus, this diesel fuel injection pump is made to be fail safe. However, it is noted that the diesel engine is made to be completely unusable and not runnable at all, when such discontinuity in the solenoid coil 105 is detected, in this first preferred embodiment.

The provision of the step 110 for checking that four fuel injection episodes in a row have occurred without any voltage spike on the solenoid coil 105, before deeming that the valve 38 has malfunctioned and is discontinuous, is not absolutely essential, but is for performing a double checking; and accordingly this step 110 may be optionally dispensed with, when appropriate, without departing from the principle of the present invention.

Further, as a useful feature of the shown construction, the set/reset state of the disconnection flag F can be stored in the backup random access memory 82D, along with other relevant variables, and an alarm can be sounded when the disconnection flag F is set; this makes the testing of the system more easy, and the discontinuity of the solenoid coil 105 can be easily confirmed by a mechanic.

Figure 8:
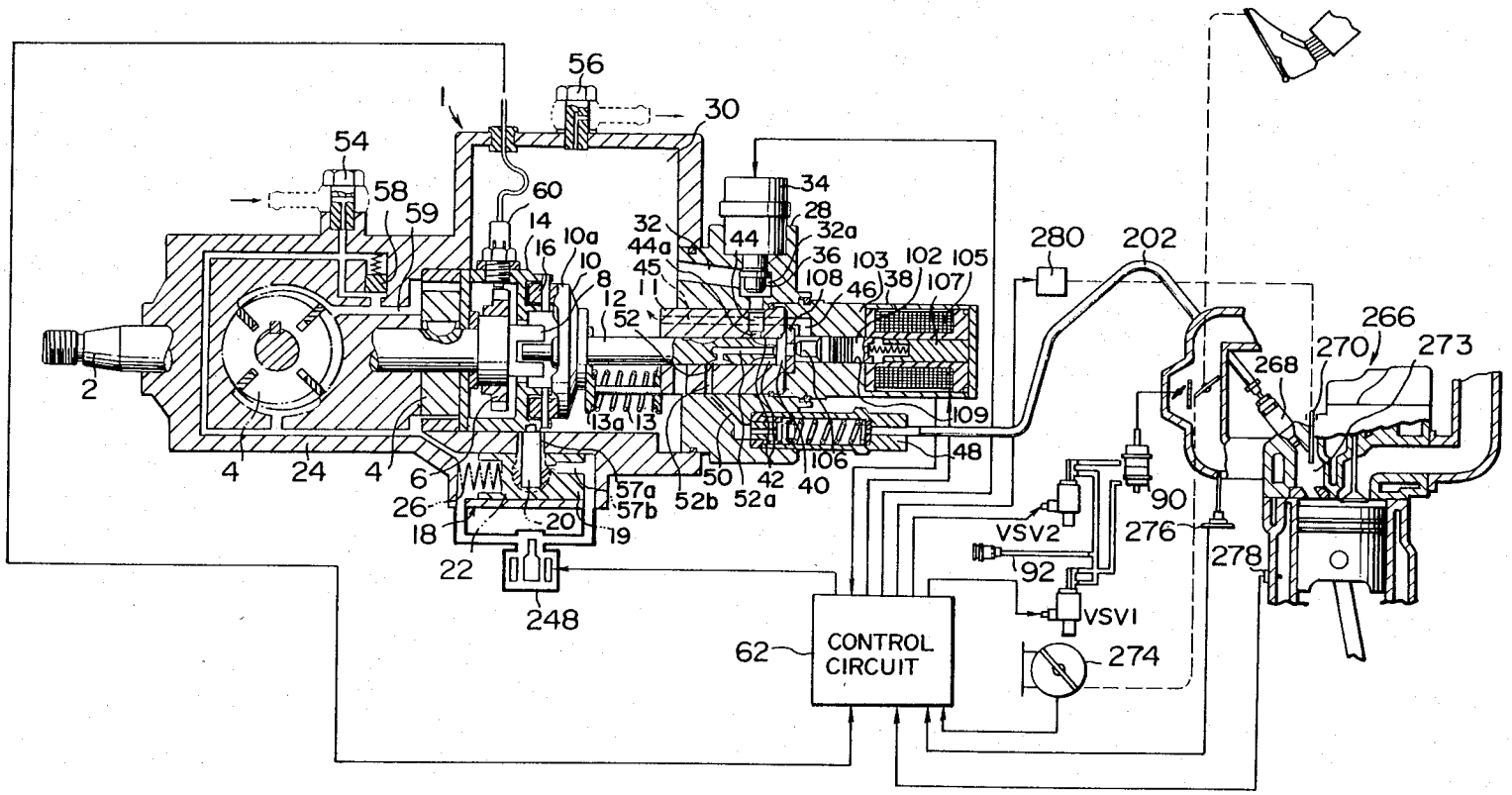
FIG. 8 is a sectional longitudinal view, similar to FIG. 1 and also in part 90° expansion, of the second preferred embodiment of the diesel fuel injection pump of the present invention, and similarly also showing a section of the diesel engine to which it is fitted, said diesel engine particularly having a venturi in its intake manifold, and also showing an accelerator pedal and a driver's foot therefor.
Figure 9:
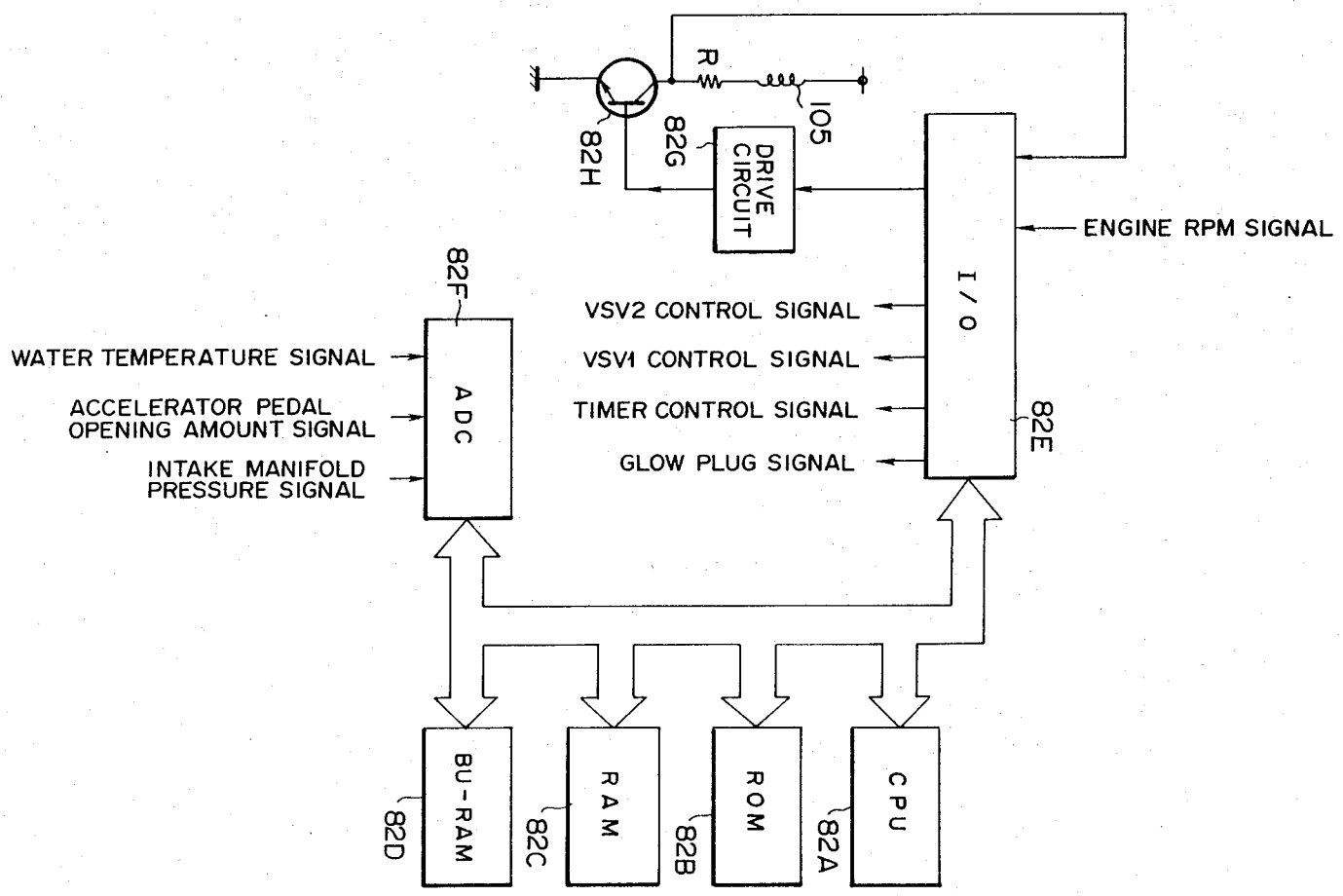
FIG. 9 is a diagrammatical view, similar to FIG. 2, of a microcomputer and of associated electrical circuitry, incorporated in the control system of this second preferred embodiment.

In FIGS. 8 and 9, a second preferred embodiment of the fuel injection pump according to the present invention is shown, in which the fail safe function operates in a somewhat different way to that of the first preferred embodiment described above. In these figures, parts which correspond to parts of the first preferred embodiment shown in FIGS. 1 and 2 respectively, and which have the same functions, are designated by the same reference numerals.

In this second preferred embodiment, the structural difference is that the intake passage of this diesel engine has a throttling construction 288, incorporating a main branch in which a main throttle valve 284 is provided, and a bypass branch in which a secondary throttle valve 286 is provided. The accelerator pedal of the vehicle is connected to said main throttle valve 284 so as to regulate the amount of intake air that can flow through said main intake branch; but, as will be seen later, the intake system is so set up and configured that this air flowing through the main intake branch is insufficient for proper engine running, without the air flowing through the bypass intake branch. The secondary throttle valve 286 is controlled by a vacuum actuator 290, which has two vacuum chambers, not particularly shown. One of these vacuum chambers is selectively supplied with vacuum from a vacuum source 292, via a first vacuum switching valve VSV1, which is an electromagnetic vacuum switching valve, and is electrically controlled by a control circuit 62 which will be described later; and the other of the vacuum chambers of the vacuum actuator 290 is selectively supplied with vacuum from said vacuum source 292, via a second vacuum switching valve VSV2, which also is an electromagnetic vacuum switching valve, and is also electrically controlled by the control circuit 62. The function of this system is that: when both of the vacuum switching valves VSV1 and VSV2 are supplied with actuating electrical energy by the control circuit 62, then vacuum is supplied to both the vacuum chambers of the vacuum actuator 292, and the secondary throttle valve 86 is completely closed; when the vacuum switching valve VSV1 is not supplied with actuating electrical energy by the control circuit 62, but the vacuum switching valve VSV2 is supplied with actuating electrical energy by the control circuit 62, then vacuum is supplied to only one of the vacuum chambers of the vacuum actuator 292, and the secondary throttle valve 86 is partly opened; and when neither of the vacuum switching valves VSV1 and VSV2 is supplied with actuating electrical energy by the control circuit 62, then no vacuum is supplied to either of the vacuum chambers of the vacuum actuator 292, and the secondary throttle valve 86 is completely opened.

Corresponding to this structure, the microcomputer in the control circuit 62 in this second preferred embodiment, as shown in FIG. 9, controls the vacuum switching valves VSV1 and VSV2 via the I/O port 82E, as well as performing the other control functions detailed with reference to the first preferred embodiment, which will not be repeated here. And the only difference in the programs performed by this microcomputer, as compared with the programs explained above with respect to the first preferred embodiment, is that: during normal operation a control signal is outputted by the control circuit 62 which causes neither of the vacuum switching valves VSV1 and VSV2 to be supplied with actuating electrical energy, so that no vacuum is supplied to either of the vacuum chambers of the vacuum actuator 292, and the secondary throttle valve 86 is completely opened; and that, in the step 118 of the fail safe routine of FIG. 6, when it has been decided that for four combustion episodes in a row the interrupt routine of FIG. 4 has not been not obeyed, i.e. no spike of voltage has appeared across the solenoid coil 105 of the electromagnetic valve 38 for fuel spilling, rather than as in the case of the first preferred embodiment completely shutting off all fuel supply to the diesel engine by transmitting an OFF signal to the solenoid of the electromagnetic valve 34 for fuel shutting off, and thereby definitely and effectively stopping the diesel engine from operating, in this second preferred embodiment a control signal is outputted by the control circuit 62 which deenergizes the vacuum switching valve VSV1 and energizes the vacuum switching valve VSV2, so as to partly close the secondary throttle valve 286 so as to greatly reduce the flow of intake air to the diesel engine. This means that, in this second preferred embodiment, if for four combustion episodes in a row the interrupt routine of FIG. 4 is not obeyed, i.e. no spike of voltage appears across the solenoid coil 105 of the electromagnetic valve 38 for fuel spilling, then the value of the count C will reach four, and then in the step 116 of the fail safe subroutine, as described above, the flow of control will be switched to the step 118 and the intake passage of the engine will be definitely considerably throttled down. In FIG. 10, a chart is shown to illustrate the effects of such throttling, with reference to a particular exemplary diesel engine. The line A indicates the engine rotational speed attained with respect to fuel injection amount in one pump stroke, when the throttling amount of the intake passage of the engine corresponds to a diameter of about 22 mm; and it is seen from this that the engine rotational speed is able to rise to realistic levels, when the fuel injection amount is increased, corresponding to maximum engine rotational speed operation at full load, since in these circumstances intake passage throttling is not in fact the limiting factor on engine rotational speed. On the other hand, the line B indicates the engine rotational speed attained with respect to fuel injection amount in one pump stroke, when the throttling amount of the intake passage of the engine corresponds to a diameter of about 12 mm; and the line C indicates the engine rotational speed attained with respect to fuel injection amount in one pump stroke, when the throttling amount of the intake passage of the engine corresponds to a diameter of about 8mm. From these lines, it will be understood that in these conditions intake passage throttling is in fact the limiting factor governing engine rotational speed, and that the engine rotational speed is prevented from rising above certain predetermined values (depending upon the effective diameter of the intake passage), no matter how much fuel is injected in each pump stroke. Thus, this action of this fail safe subroutine serves to definitely prevent the diesel engine from rotating very fast, while however still allowing emergency operation of the diesel engine at a relatively low efficiency and power output which present no substantial risk of any difficulty in operation, or of running away.

According to the structure described above, it is seen that the normal operation of the engine is completely and definitely terminated, when it is determined that the electrical characteristics of the solenoid coil 105 of the electromagnetic valve 38 for fuel spilling are abnormal, which may indicate faulty connectivity of said solenoid coil, i.e. may indicate that the valve 38 is always in the closed state and that thus a maximum amount of diesel fuel is being injected to the diesel engine irrespective of the setting of the accelerator pedal thereof. Thus, the danger of too much fuel being injected into the diesel engine, and of consequent overrunning or overrevving thereof, are positively avoided. Thus, this diesel fuel injection pump is made to be fail safe. And, in this second preferred embodiment, it is noted that the diesel engine is not made to be completely unusable and not runnable at all, when such discontinuity in the solenoid coil 105 is detected, but can in fact be operated in a reduced power mode, for instance so as to be able to limp to a service facility.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, although in the shown preferred embodiment the stopping of the diesel engine is not performed until four successive combustion episodes have proceeded for longer than they ought, this counting is only performed in order to make quite sure that abnormal combustion is occurring in the combustion chamber, and such counting could be dispensed with and the engine could be stopped after only one such occurrence of overlong combustion. Various other modifications are also possible. Further, it should be noted that the present invention is applicable to a conventional sort of mechanical diesel fuel injection pump in which the termination of each fuel injection spirt is performed by a spill ring, rather than by an electromagnetic valve as in the shown preferred embodiment. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. For a diesel engine comprising cylinders and a crankshaft: a fuel injection pump, comprising:

(a) an input shaft which is rotated in a predetermined phase relationship with said crankshaft;

(b) a housing and a plunger which slides in a bore formed in said housing and is coaxial with said input shaft, a high pressure chamber being defined at an end of said plunger between it and said bore, and another end of said plunger being rotationally engaged with said input shaft but being free to move axially with respect thereto;

(c) a means for communicating said high pressure chamber to inject fuel into one or another cylinder of said diesel engine, according to the rotational position of said plunger, substantially only when said plunger is axially moving so as to reduce the size of said high pressure chamber;

(d) an electrically actuated electromagnetic valve, comprising a solenoid coil, which selectively vents said high pressure chamber;

(e) a means for selectively actuating and deactuating said electromagnetic valve, so as to provide fuel injection in appropriate amount to said diesel engine;

(f) a means for determining whether or not the voltage across said solenoid coil of said electromagnetic valve, when said means for selectively actuating and deactuating said electromagnetic valve deactuates said electromagnetic valve from its actuated condition, rises higher than a certain value, or not;

(g) a means for restraining said diesel engine; and (h) a means for actuating said means for restraining said diesel engine if said determining means detects that said voltage across said solenoid coil of said electromagnetic valve when it is deenergized from the energized condition has not risen to higher than said certain value.

2. A fuel injection pump according to claim 1, wherein said means for actuating said means for restraining said diesel engine does so when said voltage across said solenoid coil of said electromagnetic valve when it is deenergized from the energized condition has not risen to higher than said certain value for a specified number of consecutive combustion cycles.

3. A fuel injection pump according to claim 2, wherein said specified number is plural.

4. A fuel injection pump according to claim 1, wherein said means for restraining said diesel engine completely cuts off operation of said diesel engine when actuated.

5. A fuel injection pump according to claim 4, wherein said means for restraining said diesel engine comprises a valve for cutting off supply of fuel to said high pressure chamber.

6. A fuel injection pump according to claim 1, wherein said means for restraining said diesel engine restricts the rotational speed of said diesel engine to less than a certain ceiling value, when actuated.

7. A fuel injection pump according to claim 6, said diesel engine further comprising an intake system, wherein said means for restraining said diesel engine comprises a means for restricting the flow of intake air through said intake system, when actuated.

* * * * *

UNITED STATES PATENT AND TRADEMARK OFFICE

CERTIFICATE OF CORRECTION

PATENT NO. : 4,520,780

DATED : June 4, 1985

INVENTOR(S) : Y. Ito et al.

It is certified that error appears in the above-identified patent and that said Letters Patent is hereby corrected as shown below:

Column 1, line 46, change "injectionn" to --injection--.

Column 6, line 1, change "the" to --this--.

Column 7, line 52, change "actuatig" to --actuating--.

Column 8, line 53, change "value" to --valve--.

Column 9, line 21, change "electricasl" to --electrical--.

Column 10, line 8, change "of" to --on--.

Column 10, line 64, between the words "appropriate" and "of", insert the word --one--.

Column 12, line 31, change "an spike" to --a spike--.

Signed and Sealed this

*Twenty-sixth* Day of *November 1985*

[SEAL]

*Attest:*

DONALD J. QUIGG

*Attesting Officer*

*Commissioner of Patents and Trademarks*